US009097451B2

(12) United States Patent
Lee

(10) Patent No.: US 9,097,451 B2
(45) Date of Patent: Aug. 4, 2015

(54) WATER TANK FOR REFRIGERATOR AND ICE-MAKING APPARATUS FOR REFRIGERATOR

(75) Inventor: Donghoon Lee, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 629 days.

(21) Appl. No.: 12/863,778

(22) PCT Filed: Jan. 20, 2009

(86) PCT No.: PCT/KR2009/000301

§ 371 (c)(1),
(2), (4) Date: Jul. 21, 2010

(87) PCT Pub. No.: WO2009/093834

PCT Pub. Date: Jul. 30, 2009

(65) Prior Publication Data

US 2010/0287972 A1 Nov. 18, 2010

(30) Foreign Application Priority Data

Jan. 21, 2008 (KR) ..... 10-2008-0006192

(51) Int. Cl.
*F25C 1/22* (2006.01)

(52) U.S. Cl.
CPC ..... *F25C 1/225* (2013.01); *F25C 2400/10* (2013.01); *F25C 2400/14* (2013.01); *F25D 2323/122* (2013.01)

(58) Field of Classification Search
USPC ..... 62/66, 340, 377, 389, 391; 222/166, 222/210, 461, 500, 608, 651; 137/255
See application file for complete search history.

(56) References Cited

U.S. PATENT DOCUMENTS

| | | | | | |
|---|---|---|---|---|---|
| 2,154,797 | A | * | 4/1939 | Willets | 62/316 |
| 5,427,265 | A | * | 6/1995 | Cautereels et al. | 220/318 |
| 5,971,213 | A | * | 10/1999 | Lee | 222/146.6 |
| 2008/0196440 | A1 | * | 8/2008 | Kang et al. | 62/407 |

FOREIGN PATENT DOCUMENTS

| | | | | |
|---|---|---|---|---|
| JP | 7260302 | A | * | 10/1995 |
| JP | 11-094413 | A | | 4/1999 |
| JP | 2002-107019 | A | | 4/2002 |
| JP | 2003-028547 | A | | 1/2003 |
| JP | 2004-197965 | A | | 7/2004 |
| JP | 2005-257151 | A | | 9/2005 |
| WO | WO 2004109204 | A1 | * | 12/2004 |
| WO | WO 2005026631 | A1 | * | 3/2005 |

OTHER PUBLICATIONS

International Search Report dated Sep. 9, 2009 for Application No. PCT/KR2009/000301, 2 pages.

* cited by examiner

*Primary Examiner* — Judy Swann
*Assistant Examiner* — Zachary R Anderegg
(74) *Attorney, Agent, or Firm* — Fish & Richardson P.C.

(57) ABSTRACT

Provided is a water tank for a refrigerator. The water tank includes a body part, a supply hole, and a supply part. The body part provides a space in which water for making ice is stored. The supply hole is opened to the outside of the body part. The water is introduced through the supply hole. The supply part is insertable and withdrawable into/from the body part. The supply part selectively opens the supply hole and guides the supplied water such that the water is introduced inside the body part through the supply hole. Thus, the water can be supplied by withdrawing the supply part to improve a user's convenience.

10 Claims, 3 Drawing Sheets

WATER TANK FOR REFRIGERATOR AND ICE-MAKING APPARATUS FOR REFRIGERATOR

TECHNICAL FIELD

The present disclosure relates to a water tank for a refrigerator and an ice-making apparatus for the refrigerator.

BACKGROUND ART

Generally, refrigerators are used to store food at a low temperature and are configured to refrigerate or freeze food according to the state of the food.

The inside of a refrigerator is cooled by cooling air that is continuously generated by heat exchange with a refrigerant undergoing a compression-condensation-expansion-evaporation cycle repeatedly. Supply of cool air is enabled by an evaporator disposed inside the refrigerator. Air cooled at the evaporator is distributed throughout the inside of the refrigerator by convection so that food can be kept in the refrigerator at a desired temperature.

The trends in recent refrigerators are size up and multi-functionalization based on various user demands and changes in eating habits, and thus products having various configurations are being introduced to the market.

An ice-making apparatus for generating ice is provided inside the refrigerator for user's convenience. The ice-making apparatus is provided in a refrigerator body or a refrigerator door, and configured to generate the ice using the cool air.

Water must be supplied to an ice tray in which the water is frozen in order to make the ice in the ice-making apparatus. The ice-making apparatus may have various configurations according to methods by which the water is supplied to the ice tray.

Typically, there is an ice-making apparatus in which a water supply pipe connected to an auxiliary water supply source provided for supplying the water extends to an ice tray. There is an ice-making apparatus in which an ice tray is separated and directly receives water from a water supply source, and then is installed again in a refrigerator. There is an ice-making apparatus in which water is supplied to a detachable water tank, and the water tank containing the water is installed in a refrigerator to supply the water to the ice tray.

DISCLOSURE OF INVENTION

Technical Problem

Embodiments provide a water tank for a refrigerator in which a supply part is insertably and withdrawably provided to supply water into a body part in a state where the body part is fixed.

Embodiments also provide an ice-making apparatus for a refrigerator in which a supply part insertable and withdrawable into/from a water tank can be provided to supply water into an ice tray without separating the water tank.

Technical Solution

In one embodiment, a water tank for a refrigerator includes: a body part providing a space in which water for making ice is stored; a supply hole through which the water is introduced, the supply hole being opened to the outside of the body part; and a supply part insertable and withdrawable into/from the body part, the supply part selectively opening the supply hole and guiding the supplied water such that the water is introduced inside the body part through the supply hole.

In another embodiment, a water tank for a refrigerator includes: a body part in which water to be supplied into an ice tray for making ice is stored; an opening defined in a top surface of the body part; a cover part installed on the body part to shield the opening; and a supply part insertable and withdrawable into/from the body part, the supply part being withdrawn to guide the water into the body part when the water for making ice is injected, wherein the water for making the ice is selectively supplied into the body part through the opening or the supply part.

In further another embodiment, an ice-making apparatus for a refrigerator includes: an external case provided in a freezer or a freezing compartment door, the external case defining an outer appearance; at least one or more ice trays rotatably disposed inside the external case; a water tank above the ice trays, the water tank storing water for making ice using the ice trays; and a supply part withdrawable from the water tank to the outside, the supply part guiding the water injected from the outside such that the water flows into the water tank.

Advantageous Effects

According to embodiments, the water for making the ice can be introduced into the water tank through the supply part without separating the water tank from the ice-making apparatus. That is, the supply part can be withdrawn in the front direction in a state where the ice-making apparatus is installed inside the refrigerator to supply the water into the water tank and the ice tray.

Thus, the water tank does not have to be separated. As a result, it can prevent a limitation that the water tank is dropped due to carelessness, or the water overflows when the water tank is installed.

Therefore, the user can expect improved usage convenience, and also user's dissatisfactions such as the dropping of the water tank or overflow of the water can be solved.

MODE FOR THE INVENTION

Hereinafter, specific embodiments of the present disclosure will be described with reference to the accompanying drawings. However, the spirit of the invention is not limited to the embodiments. Other retrograde inventions by adding, changing or deleting other components or other embodiments within the scope of the invention may be easily proposed.

Figure 1:
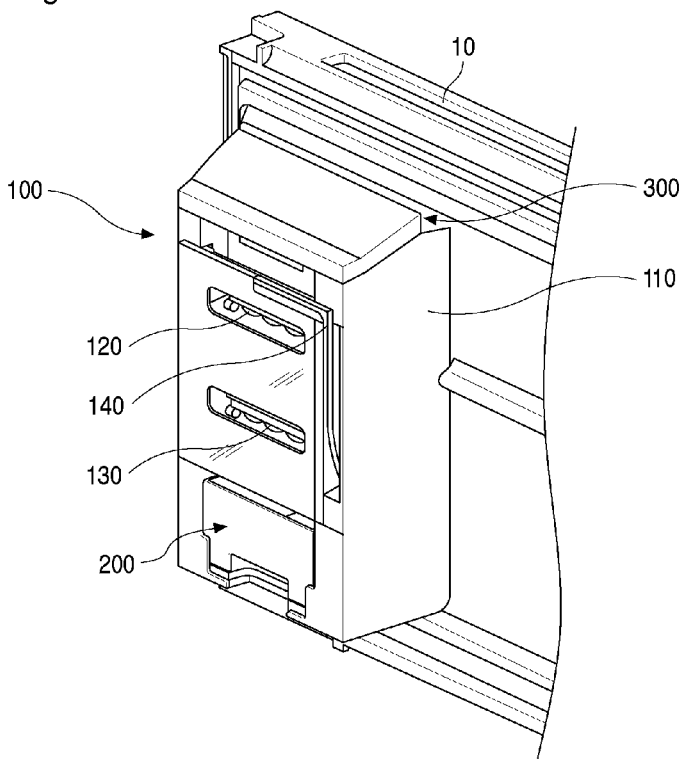
FIG. 1 is a partial perspective view of an ice-making apparatus installed in a door according to an embodiment.

FIG. 1 is a partial perspective view of an ice-making apparatus installed in a door according to an embodiment.

Referring to FIG. 1, an ice-making apparatus 100 for a refrigerator is coupled to the inside of a refrigerator door 10. The refrigerator door may be a freezing compartment door in order to generate ice by the ice-making apparatus 100. However, in case where an auxiliary device for supplying cool air into the ice-making apparatus 100 is added, the ice-making apparatus 100 may be provided in a refrigerating compartment door.

The ice-making apparatus 100 includes an external case 110, an ice tray 120 and 130, an ice bank 200, and a water tank 300. The external case 110 defines a general outer appearance. The ice tray 120 and 130 is received in the external case 110. The ice bank 200 is disposed below the ice tray 120 and 130 to store ice made in the ice tray 120 and 130. The water tank 300 is disposed above the ice tray 120 and 130 to store water to be supplied to the ice-making apparatus 100.

In detail, the ice-making apparatus 100 includes an ice trays 120 and 130, a lever 140, and a power transmission gear (not shown). The ice trays 120 and 130 are rotatably provided inside the external case 110. The lever 140 rotates the ice trays 120 and 130. The power transmission gear transmits a rotation force of the lever 140 to the ice trays 120 and 130.

The ice trays 120 and 130 include an upper ice tray 120 and a lower ice tray 130. A rotation shaft of the lower ice tray 130 is spaced backwardly a predetermined distance from that of the upper ice tray 120 to prevent ice contained in the upper ice tray 120 from being dropped into the lower ice tray 130 when the upper ice tray 120 is rotated.

The lever 140 has a substantially "ㄱ" shape when viewed from front and is pivotally coupled to the inside of the external case 110 to pivot in a front direction, and thus generate the rotation force.

The rotation force of the lever is transmitted to the power transmission gear (not shown) including a plurality of gears, and the ice trays 120 and 130 are rotated in the same direction as a rotation direction of the lever 140.

The ice bank 200 for storing the ice conveyed from the ice trays 120 and 130 due to the rotation of the lever 140 is disposed below the ice tray 130. The ice bank 200 has a rectangular parallelepiped box shape having an opened top surface and defines a space for storing the ice.

The ice bank 200 is disposed below the ice tray 130 and is slidingly withdrawable in a front direction. A user can withdraw the ice bank 200 as necessary to dispense the ice within the ice bank 200.

The water tank 300 for storing the water to be supplied to the ice trays 120 and 130 is disposed upper part ice-making apparatus 100. The water tank 300 is slidingly withdrawable in an upward direction of the ice-making apparatus 100. The water tank 300 may be separated and then receive water therein. Alternatively, the water tank 300 may include a supply part (see reference numeral 350 of FIG. 2) on a front surface of the water tank 300 to receive water therein without their separation from the refrigerator. A configuration of the water tank 300 will now be described in detail.

Figure 2:
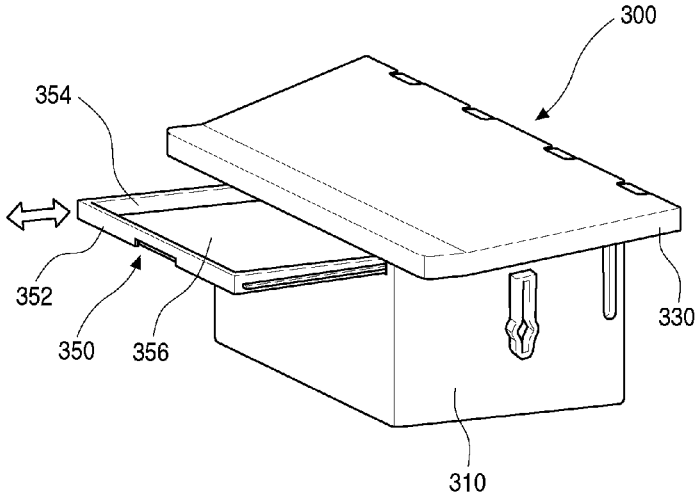
FIG. 2 is a perspective view of a water tank with a supply part withdrawn according to an embodiment.
Figure 3:
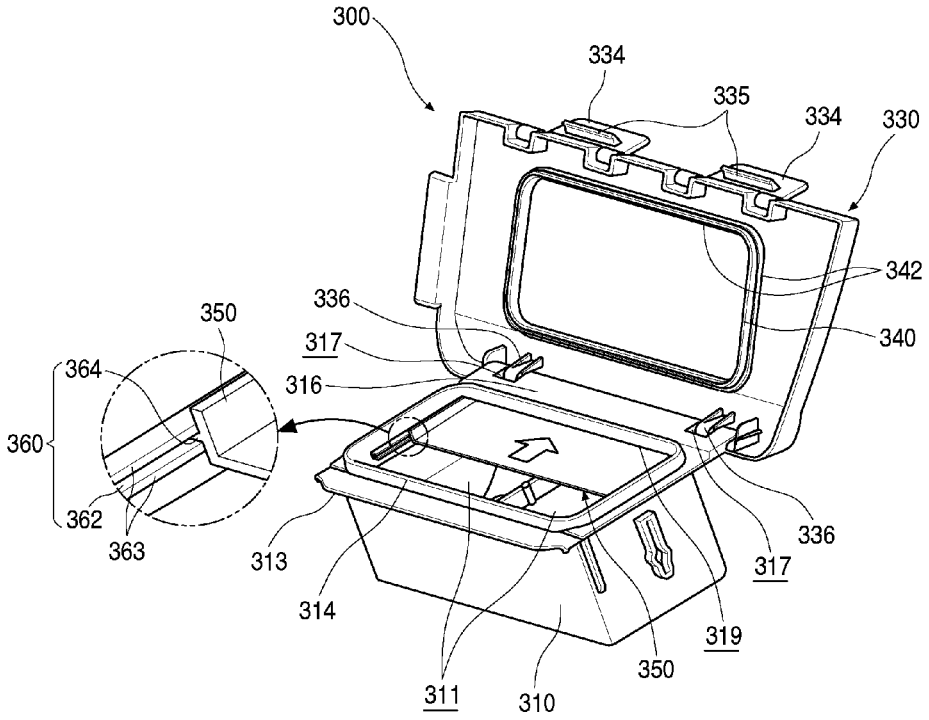
FIG. 3 is a perspective view of a water tank with a cover part opened according to an embodiment.

FIG. 2 is a perspective view of a water tank with a supply part withdrawn according to an embodiment, and FIG. 3 is a perspective view of a water tank with a cover part opened according to an embodiment.

Referring to FIGS. 2 and 3, the water tank 300 includes a body part 310 and a supply part 350. The body part 310 defines a space for storing the water. The supply part 350 is disposed on a surface of the body part 310 to provide a passage through which the water is introduced inside the body part 310. A cover part 330 for selectively shielding a top surface of the body part 310 is further provided on a top surface of the body part 310. The cover part 330 is an additional component for conveniently injecting the water into the body part 310 in a state where the body part 310 is separated from the ice making apparatus. Thus, the cover part 330 is not required additionally when the top surface of the body part 310 is not opened. Hereinafter, the ice making apparatus including the cover part 330 will be described as one example.

In detail, the body part 310 is formed of a transparent or semitransparent material having a rectangular parallelepiped box shape with an opened top surface. A water storage space 311 for storing the water is defined in the body part 310. Since the body part 310 is formed of the transparent or semitransparent material, a water supply amount supplied into the water storage space 311 is showed.

The water storage space 311 is partitioned by a partition. Thus, the water may be separately supplied into the upper and lower ice trays 120 and 130 of the ice-making apparatus 100. Although not shown, a discharging part for selectively discharging the water contained in the water storage space 311 may be further provided in a bottom surface of the water storage space 311.

That is, when the water tank 300 containing the water is inserted into an upper side of the ice-making apparatus 100, the discharging part separately supplies the water within the water storage space into the ice trays 120 and 130, and when the water tank 300 is withdrawn, the discharging part prevents the water from leaking to the outside.

A hook end 313 to which a locking member 334 of the cover part 330 is coupled protrudes in a front direction from an upper end of a front surface (when viewed in FIG. 3) of the body part 310.

The hook end 313 is integrated with the body part 310 when the body part 310 is fabricated. The hook end 313 has a plate shape having a predetermined thickness to interfere with the locking member 334.

A pressing rib 314 for pressing a sealing member 340 coupled to a lower surface of the cover part 330 when the cover part 330 is closed is provided on a top surface of the body part 310. The pressing rib 314 is integrated with the body part 310 when the body part 310 is fabricated. The pressing rib 314 protrudes upwardly along circumference of the top surface of the body part 310 disposed on a position corresponding to that of the sealing member 340.

A coupling end 316 hinge-coupled to the cover part 330 is disposed on an upper end of a back surface (when viewed in FIG. 3) of the body part 310. The coupling end 316 is integrated with the body part 310 when the body part 310 is fabricated. The coupling end 316 protrudes in a rear direction (when viewed in FIG. 3) and has a predetermined thickness and width to couple the cover part 330 thereto.

A hinge hole 317 hinge-coupled to the cover part 330 is punched and defined in the coupling end 316.

The cover part 330 for selectively shielding the opened top surface of the body part 310 is disposed on the top surface of the body part 310. The cover part 330 has a downwardly opened rectangular box shape having a size greater than that of the top surface of the body part 310. A portion of the top surface of the body part 310 is received in the cover part 330. Thus, since the portion of the top surface of the body part 310 is not exposed to the outside, an outer appearance of the water tank 300 becomes more elegant. Since the cover part 330 is formed of a transparent or semitransparent material, an amount of water supplied into the body part 310 is shown through the supply part 350 even through the cover part 330 is closed The locking member 334 interfering with the hook end 313 to prevent the cover part 330 from being opened is disposed on a front end (when viewed in FIG. 3) of the cover part 330.

The locking member 334 is pivotally hinge-coupled to the front end of the cover part 330. A interference protrusion 335 protrudes toward the body part 310 to interfere with the hook end 313 at a position corresponding to that of the hook end 313 when the cover part is closed. Thus, in a case where the cover part 330 is pushed downwardly, the locking member 334 is pivoted downwardly to allow the interference protrusion 335 to be hooked with a lower portion of the hook end 313 to close the cover part 330.

A hinge 336 allowing the cover part 330 to be pivoted is disposed in the cover part 330 at a position corresponding to that of the hinge hole 317 of the coupling end 316.

The sealing member 340 for shielding a space between the cover part 330 and the body part 310 to prevent the water within the body part 310 from leaking is disposed on a bottom surface of the cover part 330 at a position corresponding to that of the pressing rib 314. The sealing member 340 is formed of a rubber material having elasticity including a silicon rubber. The sealing member 340 is pressed by interfering with the pressing rib 314 to shield the space between the body part 310 and the cover part 330.

The sealing member 340 is inserted into a coupling recess (not shown) that is a space between a pair of coupling ribs 342 protruding downwardly from the bottom surface of the cover part 330, and thus is fixed to the bottom surface of the cover part 330.

The supply part 350 for providing a passage through which water is introduced into the body part 310 is disposed on a front surface (when viewed in FIG. 2) of the body part 310. The supply part 350 selectively opens a supply hole 319 defined in the front surface of the body part 310 to introduce the water into the body part 310 through the supply hole 319.

The supply part 350 is slidingly withdrawn from the front surface (when viewed in FIG. 2) of the body part 310 to open the supply hole 319. The water is poured into the supply part 350 to supply the water into the water tank 300 through the body part 310.

The supply hole 319 is punched in a shape corresponding to that of a front surface 352 of the supply part 350. When the supply part 350 is withdrawn in a front direction, the supply hole 319 is opened. Thus, when the water is poured into the supply part 350, the water is introduced into the water storage space 311. The water introduced into the water storage space 311 is supplied into the ice trays 120 and 130 through the discharging part (not shown).

Guide parts 360 for slidingly guiding insertion and withdrawal of the supply part 350 have shapes corresponding to each other and are disposed on both sidewalls of the water storage space 311 and both side surfaces of the supply part 350. The guide parts 360 include guide protrusions 364 and guide recesses 362, respectively. Although the guide protrusions 364 are disposed on the both side surface of the supply part 350, and the guide recesses 362 are disposed on the both sidewalls of the water storage space 311 in FIG. 3, the present disclosure is not limited thereto, and vice versa is permissible without departing the scope of the present disclosure.

Each of the guide recesses 362 is a space defined between a pair of guide ribs 363 protruding up to a height corresponding to that of each of the guide protrusion 364 in a direction opposite to each other from the both sidewalls of the body part 310. The guide recess 362 extends in a rear direction of the supply hole 319 to guide the sliding movement of the supply part 350.

Hereinafter, the supply part 350 will be described.

Figure 4:
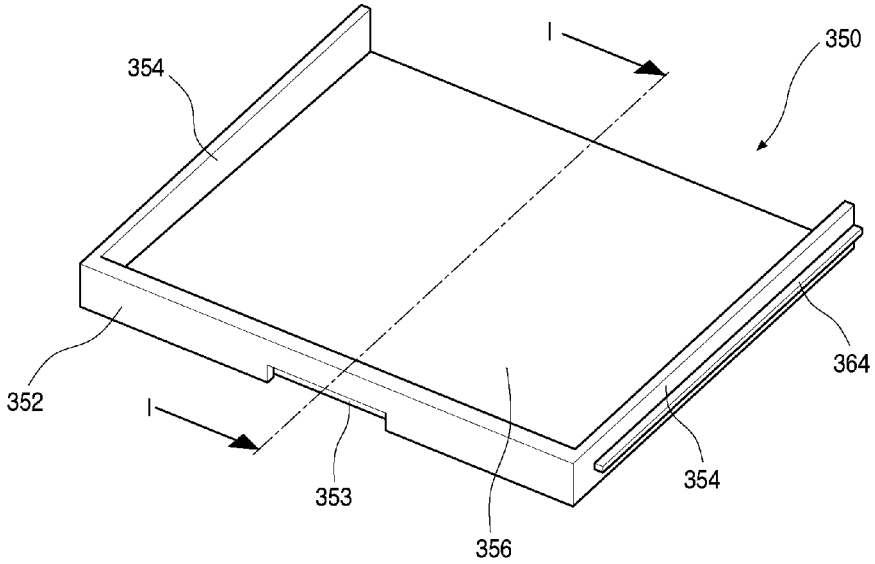
FIG. 4 is a perspective view illustrating an outer appearance of a supply part of a water tank according to an embodiment.
Figure 5:
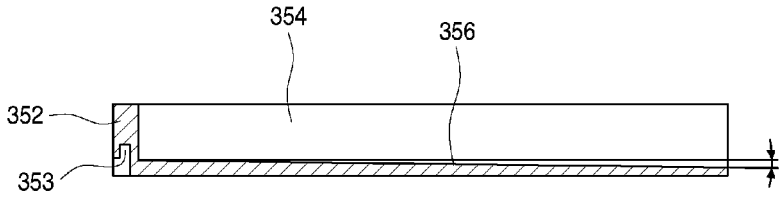
FIG. 5 is a cross-sectional view taken along line I-I of FIG. 4.

FIG. 4 is a perspective view illustrating an outer appearance of a supply part of a water tank according to an embodiment, and FIG. 5 is a cross-sectional view taken along line I-I of FIG. 4.

Referring to FIGS. 4 and 5, the supply part 350 includes a front surface 352, a pair of sidewalls 354, and a bottom surface 356. The front surface 352 selectively shields the supply hole 319. The sidewalls 354 extend in a rear direction from both ends of the front surface 352. The bottom surface 356 connects lower ends of the sidewalls 354 to each other. The supply part 350 has a rectangular parallelepiped box shape having opened top and bottom surfaces. A passage through which the water supplied from the supply part 350 flows is provided in the supply part 350.

In detail, the front surface 352 has a shape and size corresponding to those of the supply hole 319. The front surface 352 is withdrawn in a front direction when the water is supplied into the water tank 300. The front surface 352 is inserted in a rear direction to shield the supply hole 319 when the water is completely supplied into the ice trays 120 and 130. A handle 353 grasped by a user to easily withdraw the supply part 350 is recessingly positioned in a lower portion of the front surface 352.

The pair of sidewalls 354 has the same height as that of the front surface 352. The sidewalls 354 extend in a rear direction of the front surface 352 to prevent the water from overflowing around the supply part 350.

The guide protrusion 364 having a shape corresponding to that of the guide recess 362 protrudes from an outer surface of each of the sidewalls 354. The guide protrusion 364 has a size corresponding to that of the guide recess 362. The guide protrusion 364 is inserted into the guide recess 362 to guide the sliding movement of the supply part 350.

The lower ends of the sidewalls 354 are connected to the bottom surface 356. When the water is introduced from the supply part 350, the lower ends of the sidewalls 354 guide the water to introduce the water into the water storage space 311 through the supply hole 319 along the bottom surface 356. Thus, the bottom surface 356 is inclined from a front end toward a rear end in order to smoothly move the water introduced from the supply part 350. That is, as illustrated in FIG. 5, the bottom surface 356 is inclined such that a section height of the front end of the bottom surface 356 is greater than that of the rear end thereof. Thus, the water introduced into the supply part 350 is smoothly moved into the body part 310 due to the inclined bottom surface 356. Also, it is obvious that the scope of the present disclosure also includes the case wherein the supply part 350 is inclinedly coupled to the body part 310 without requiring the inclined bottom surface 356.

The supply part may include various configurations different from that of the above-described embodiment, and it will now be described. Since another embodiment of the present disclosure is the same as the above-described embodiment except a supply part and a portion of the configurations, the same configurations will be referred to by the same reference numerals, and detailed description thereof will be omitted.

Figure 6:
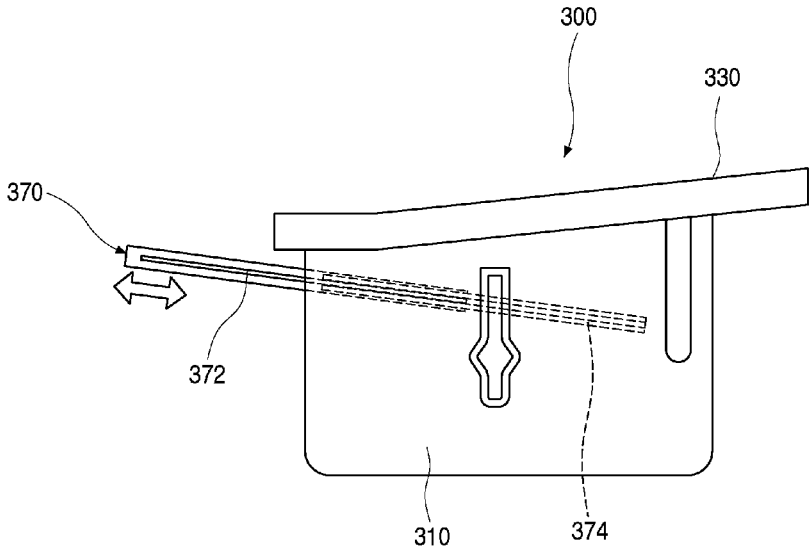
FIG. 6 is a side view of a water tank with a supply part withdrawn according to another embodiment.

FIG. 6 is a side view of a water tank with a supply part withdrawn according to another embodiment.

Referring to FIG. 6, a water tank 300 is defined by a body part 310 and a cover part 330. The body part 310 stores water for making ice, and an opened top surface of the body part 310 is selectively shielded by the pivotable cover part 330. Thus, in order to inject the water into the water tank 300, the cover part 330 is pivoted to open the body part 310.

The water tank 300 may supply the water in a state where the water tank 300 is installed in an ice-making apparatus 100 (see FIG. 1). For this, an additional supply part 370 for supplying the water into the water tank 300 may be provided. The supply part 370 is insertably and withdrawably disposed on a side of the body part 310. That is, the supply part 370 can be inserted and withdrawn in front and rear directions by user's manipulation.

The supply part 370 has a shape such as a drawer having opened top and back surfaces. Thus, a user withdraws the supply part 370 in order to inject the water, and then the user pours the water into the supply part 370. As a result, the water for making ice flows inside the body part 310 along the supply part 370.

In detail, the supply part 370 is inclined such that the supply part 370 is withdrawn in an upward direction of the body part 310. That is, a guide protrusion 372 and a guide recess 374 respectively disposed on/in the supply part 370 and the body part 310 are inclined downwardly from a front direction to a rear direction (left side when viewed in FIG. 6).

Thus, the supply part 370 is inclined such that a front portion of the supply part 370 is disposed at a position higher than that of a rear portion thereof when the supply part 370 is withdrawn. When the water is injected into the supply part 370, the water flows inside the body part 310 along the inclined surface of the supply part 370.

Hereinafter, an operation of an ice-making apparatus 100 for a refrigerator having the above-described configurations will be described.

The water is filled into the water tank 300 by the user in order to obtain the ice. A method for filling the water tank 300 with the water is divided into a method in which the water tank 300 is separated to fill the water tank 300 with the water and a method in which the supply part 350 is opened to fill the water tank 300 with the water.

First, the water tank 300 is separated from the ice-making apparatus 100, and the cover part 330 is opened. Then, the water is filled into the body part 310, and the water tank 300 is coupled to the ice-making apparatus 100. The water within the water tank 300 is supplied into the ice-making apparatus 100 through a predetermined passage.

Second, in a state where the water tank 300 is coupled to the ice-making apparatus 100, the user withdraws the supply part 350 in the front direction to pour the water into the supply part 350, and thus, the water tank 300 is filled with the water.

In detail, when the supply part 350 is withdrawn in the front direction in a state where the handle 353 is grasped, the supply part 350 is withdrawn in the front direction by the guide protrusion 364 slid along the guide recess 362. When the supply part 350 is withdrawn by a predetermined distance, a certain quantity of water is injected into the supply part 350. Then, the injected water is introduced into the body part 310 along the bottom surface 356 of the supply part 350. The introduced water is supplied into the ice trays 120 and 130 along a certain passage.

The water supplied into the ice trays 120 and 130 is frozen by the cool air introduced into the ice-making apparatus 100. When the ice is generated in the ice trays 120 and 130, the user pivots the lever 140. The rotation force of the lever 140 is transmitted to the power transmission gear (not shown) to rotate the ice trays 120 and 130. Thus, the ice generated in the ice trays 120 and 130 is stored in the ice bank 200 disposed below ice trays 120 and 130. The user dispenses the ice within the ice bank 200, if necessary.

Industrial Applicability

According to the embodiments, the water can be supplied into the body part of the water tank by withdrawing the supply part. Thus, since the water for making the ice can be supplied without detaching the water tank, the ice making apparatus is expected to improve user's convenience, thereby increasing industrial applicability.

The invention claimed is:

1. An ice-making apparatus for a refrigerator comprising:
an external case disposed in a freezer compartment;
an ice tray;
a body part detachably mounted to the external case and including a space to store water, the body part having an upper opening, a lower discharge part to selectively discharge water to the ice tray, a supply part insertion hole located on a front of the body part, and guide recesses that extend from the supply part insertion hole on an inner surface of the body part;
a cover part connected to the body part and arranged to cover the upper opening, the cover part having a first end hingedly coupled to the body part and a second end provided with a locking member; and
a water supply part provided with guide protrusions corresponding to the guide recesses and a handle located at a front side of the water supply part, wherein the guide protrusions pass through the supply part insertion hole and water is able to be supplied to the space of the body part in a state in which at least a portion of the water supply part is withdrawn from the body part,
wherein the water supply part is provided at the body part and adjacent to the cover part, and
wherein, when the supply part is inserted in the supply part insertion hole, the cover part and the supply part are oriented such that water supplied through the upper opening when the cover part is opened, contacts the supply part before reaching the body part.

2. The ice-making apparatus for the refrigerator according to claim 1, wherein at least one of the cover part and the body part is formed of a transparent or semitransparent material that enables viewing an inside of the body part therethrough.

3. The ice-making apparatus for the refrigerator according claim 1, wherein the guide protrusions and the guide recesses are inclined downwardly from a front direction toward a rear direction of the body part.

4. The ice-making apparatus for the refrigerator according to claim 1, wherein the supply part comprises:
side parts defining left and right side surfaces of the supply part,
a bottom part that connects lower ends of the side parts to each other and that is inclined downwardly toward a rear direction of the supply part, and
a front part that contacts front ends of the side parts and the bottom part and that is configured to shield the supply part insertion hole formed in the portion of the front wall of the body part when the supply part is inserted into the body part through the supply part insertion hole,
wherein the body part is configured to receive water that is supplied through the upper opening when the cover part is opened and the body part is configured to receive water through the supply part insertion hole when the supply part is drawn out.

5. The ice-making apparatus for the refrigerator according to claim 1, further comprising a sealing member disposed on a bottom surface of the cover part to shield the space between the body part and the cover part.

6. The ice-making apparatus for the refrigerator according to claim 1, wherein the supply part has a drawer shape having opened top and back surfaces.

7. The ice-making apparatus for the refrigerator according to claim 1, wherein an inside of the body part is partitioned to separately supply water into a plurality of ice trays.

8. The ice-making apparatus for the refrigerator according to claim 1, wherein a front surface of the supply part is exposed to an outside of the external case and the front surface of the supply part shields the supply part insertion hole when the supply part is inserted into the body part.

9. The ice-making apparatus for the refrigerator according to claim 1, wherein a bottom surface of the supply part is inclined downwardly from a front direction toward a rear direction of the body part.

10. The ice-making apparatus for the refrigerator according to claim 9, wherein the guide protrusions and the guide recesses are inclined downwardly from a front direction toward a rear direction of the body part.

* * * * *